United States Patent [19]

Achelpohl

[11] 4,069,944

[45] Jan. 24, 1978

[54] APPARATUS FOR SEPARATING AND SUPPLYING VALVED SACKS TO FILLING MACHINES

[75] Inventor: Fritz Achelpohl, Lengerich of Westphalia, Germany

[73] Assignee: Windmoller & Holscher, Lengerich of Westphalia, Germany

[21] Appl. No.: 695,113

[22] Filed: June 11, 1976

[30] Foreign Application Priority Data

June 13, 1975 Germany ..... 2526432

[51] Int. Cl.[2] ..... B65B 9/02

[52] U.S. Cl. ..... 221/72; 242/75.1

[58] Field of Search ..... 221/259, 72–74; 198/461; 271/8; 242/99, 75.1

[56] References Cited

U.S. PATENT DOCUMENTS

| | | | |
|---|---|---|---|
| 2,471,055 | 5/1949 | Asbill, Jr. | 221/72 X |
| 3,061,225 | 10/1962 | Huck | 242/75.1 |

FOREIGN PATENT DOCUMENTS

| | | | |
|---|---|---|---|
| 689,699 | 4/1965 | Italy | 221/73 |

*Primary Examiner*—Stanley H. Tollberg
*Attorney, Agent, or Firm*—Fleit & Jacobson

[57] ABSTRACT

In an apparatus for separating valved sacks which are, with the aid of holding bands, coiled in an overlapping formation as a reel and for feeding the separated sacks to a filling machine, a stand for rotatably mounting the reel is provided with a frame carrying a guide roller at each end. An endless driven belt passed over the guide rollers presses against the reel periphery to turn the reel and unwind the overlapping sacks and their holding bands. The holding bands are coiled on spools of the frame while the overlapping sacks are fed to a conveyor which moves faster than the endless belt so as to separate the successive sacks from the overlapping formation.

26 Claims, 5 Drawing Figures

APPARATUS FOR SEPARATING AND SUPPLYING VALVED SACKS TO FILLING MACHINES

The invention relates to an apparatus for separating valved sacks stored in overlapping formation on reels and supplying same to filling machines.

In an apparatus of this kind known from U.S. Pat. No. 3,691,715, stacks of valved sacks are filled into a magazine with one side standing on edge. A pivotable gripper provided with suction cups withdraws the foremost sack from the magazine and, whilst turning it through 90°, inserts it in holding tongs which then transport the sack to the filling nipple of the filling machine whilst holding the valve open. By reason of static charging or adhesion, however, the sacks in the magazine can adhere to one another so strongly that the grippers remove more than one sack from the magazine, this resulting in disturbances and interruptions in operation. Plastics sacks are particularly difficult to remove from a stack because of their smooth surface and their low bending stiffness. The storage of the valved sacks to be filled in stacks in magazines can also lead to the sacks becoming so deformed that they cannot be properly grasped and their valves cannot be properly opened, this giving rise to possible defects in the filling operation and losses of filling material and sack material.

Because of the particular problem of storing the valved sacks and separating same for the purpose of filling, the Applicants have suggested in their prior Application P 24 00 265.1-27, now U.S. Pat. No. 3,952,479, that a web of the valved sacks that, for the purpose of separating the sacks, has to be severed between two transverse weld seams associated with successive sacks be coiled to form a reel of valved sacks, that the reel be suspended in an unwinding apparatus, a pair of feed rollers or a double belt conveyor for supplying the unwound web of successive sacks being instrumental in inserting the foremost sack in transporting means leading to the filling nipple, and that a severing apparatus be provided for severing the sack inserted in the transporting means. This filling process suggested by the Applicants has proved successful in practice but can be carried out only with valved sacks that are interconnected to form a web. The valved sacks must therefore be made in a special manner; cross-bottom valved sacks which are not interconnected as a web cannot be filled by this method.

The invention is based on the discovery that it is particularly easy to separate valved sacks which are superposed in an overlapping formation and which are coiled to form a transportable reel of overlapping sacks with the aid of at least one holding band.

It is an aim of the invention to provide an apparatus with which valved sacks coiled as a reel of overlapping sacks can be reliably separated and fed to filling machines.

According to the invention, this aim is achieved in that a stand is provided with bearings for receiving the reel, the stand comprising a frame carrying rollers at opposite ends, that a driven endless belt passes over the rollers and the frame can be applied to the reel or the reel to the frame so that the endless belt presses on the reel periphery for driving same, and that the stand is provided with spools for coiling the holding bands that are pulled off together with the overlapping sacks during unreeling thereof and with a supply belt downstream of the endless reel-driving belt for transporting the overlapping valved sacks, the supply belt being followed by conveyor means which separate the overlapping valved sacks and successively lead same at a faster speed to the means for feeding them to the filling machine. By means of the apparatus according to the invention, the supply reel is rotated in synchronism with the unwound overlapping formation so that neither a gap nor a building up of the bags can occur between the supply reel and the withdrawn overlapping formation. The pressure belt drive engaging the periphery of the reel first of all ensures an effective drive which takes due account of the inertia of the reels and at the same time prevents loosening of the reel and secondly the driving pressure belt can be combined in a simple manner with a supply belt for transporting the overlapping sacks further.

Desirably, the frame leading the pressure belt over rollers is in the form of a rocker and can be pressed against the reel periphery by a piston-cylinder pressure unit. The reel-driving belt can be passed over further rollers to form the supply belt for transporting the unreeled overlapping valved sacks. Desirably, there is provided for separating the valved sacks from the overlapping formation a faster conveyor belt above the upstream end of which there is a cylinder or rollers for pressing the arriving sacks against said belt.

Other advantageous features of the invention are described in more detail in the subsidiary claims.

An example will now be described in more detail with reference to the drawing in which.

Figure 1:
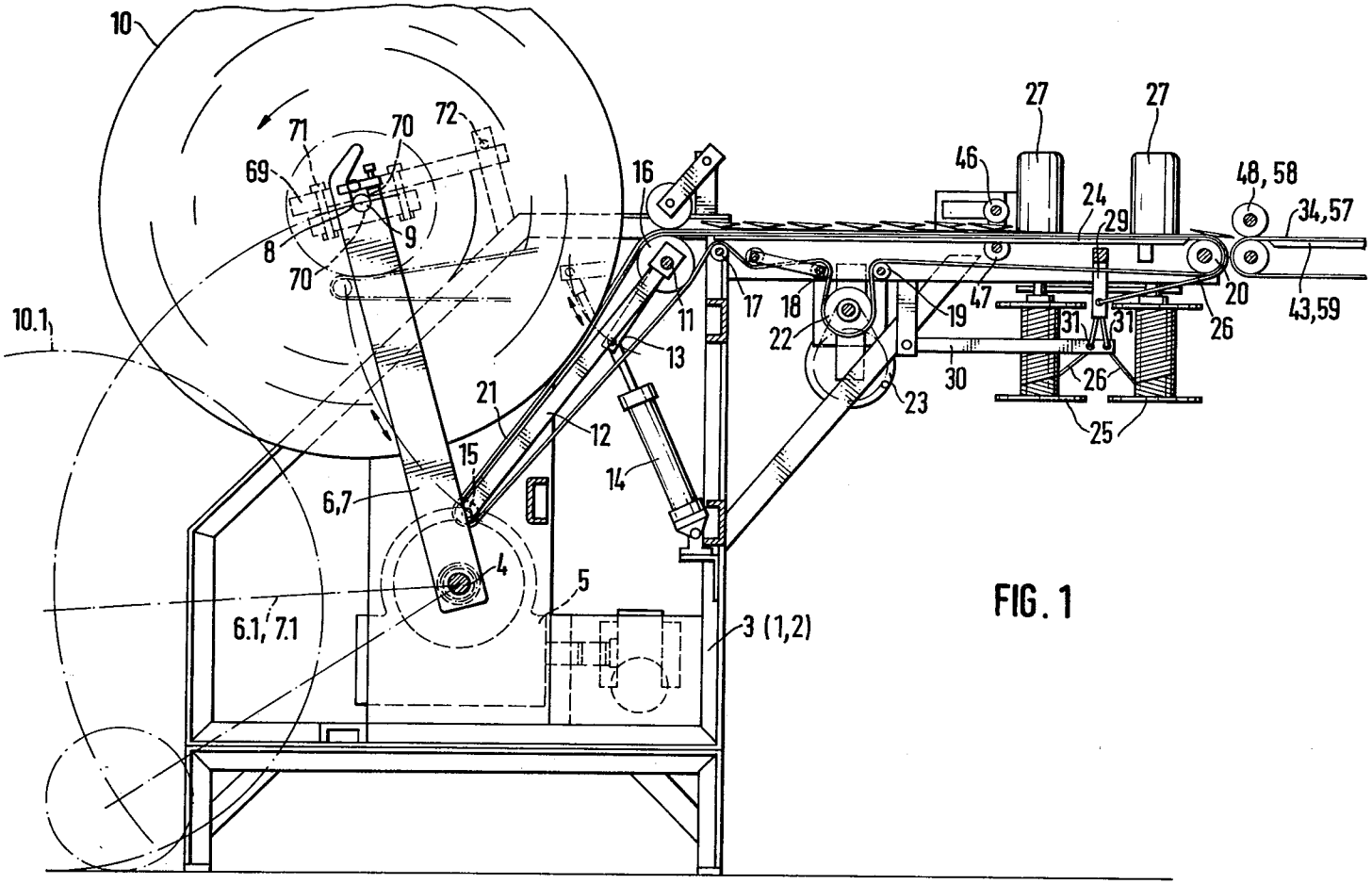
FIG. 1 is a diagrammatic side elevation in which the front side portion of the stand has been omitted.
Figure 2:
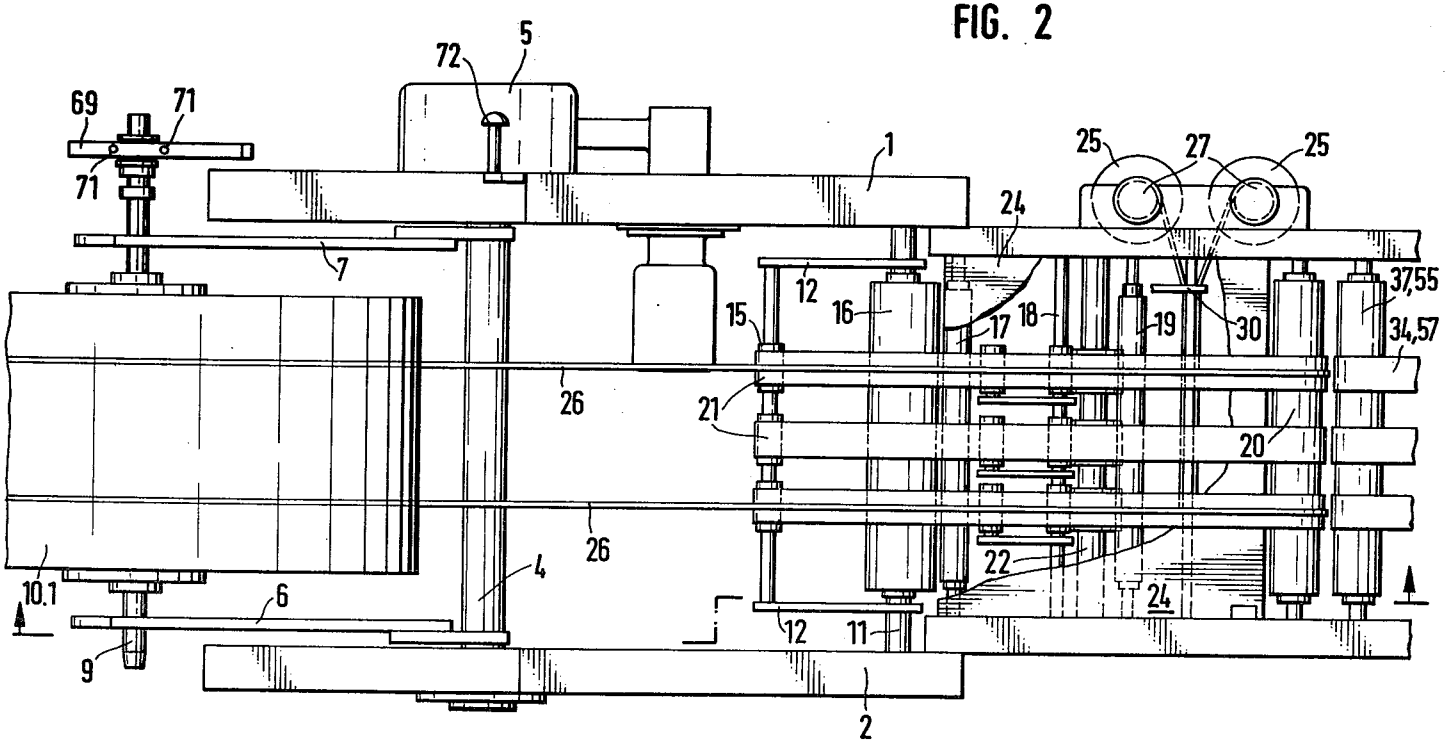
FIG. 2 is a plan view of the FIG. 1 apparatus with the supply reel lowered.

Two side members 1 and 2 form a stand 3 of the apparatus. A shaft 4 is rotatably mounted in it. It can be self-lockingly rotated by means of a gear motor 5 secured to the stand 3. Arms 6 and 7 are mounted on the shaft 4 that have receiving emplacements 8 at their end. The arms 6, 7 can be swung substantially to a position 6.1 or 7.1 at which the receiving emplacements 8 engage a shaft 9 fitted to a supply reel 10 in the 10.1 position of the supply reel 10 and can lift the supply reel 10 to the unreeling position shown in full lines by turning the shaft 4. Mounted on the shaft 9 there is a rotary brake 69 which consists of two segments similar to a Prony brake, which have semi-circular recesses 70 fitting over the shaft 9 and are covered with a material that resembles brake lining. The two segments are pressed against the shaft 9 by means of bolts 71. Fixed to the stand 3 there is a pin 72 against which one segment of the rotary brake 69 abuts. In this way the force corresponding to the torque is transmitted to the stand 3. By turning the bolt 71, the torque of the brake can be adjusted.

Also rotatably mounted in the stand 3 there is a shaft 11 to which two arms 12 and 13 are secured. Pivoted to the arms 13 there are the piston rods of piston-cylinder pressure units 14 of which the cylinders are hinged to the stand 3.

Guide rollers 16 to 20 are rotatably mounted in the stand 3 and a guide roller 15 is rotatably mounted on the arm 12. These guide rollers guide conveyor belts 21 which, together with the guide rollers 15, 16, form a drive member for the supply reel 10. The conveyor belts 21 also pass over a roller 22 which is driven by a gear motor 23. By means of the piston-cylinder pressure units 14, the belts 21 are pressed against the supply reel 10 in the region between the guide rollers 15 and 16. The guide roller 16 is rotatably mounted on the shaft 11 and at the same time serves to guide the runs of the conveyor belts 21 leading to the supply reel and the runs coming off the supply reel. Near the guide rollers 16 and 20, the overlapping formation of sacks is kept from sagging by a table 24 extending beneath those runs of the conveyor belts 21 that come off the supply reel 10. Spools 25 for coiling the holding bands 26 withdrawn from the supply reel 10 are provided on the stand 3 and are driven by rotary field magnets 27.

The holding bands 26 are deflected downwardly over the guide roller 20. Beneath the table 24 there are two band guide plates 29 which each have a guide hole through which one of the holding bands 26 is passed and deflected through about 90° towards the spools 25. Further, there is an oscillatable guide rod 30 adjacent the spools 25, the front end of the rod containing two holes 31 through which the holding bands 26 pass to the spools 25. The gear motor 23 drives a cam plate (not shown) by means of which the oscillating movement of the guide rod 30 is achieved in conformity with the feed of the conveyor belts 21. In this way the holding bands 26 are evenly coiled on the spools 25 over their entire length.

Figure 3:
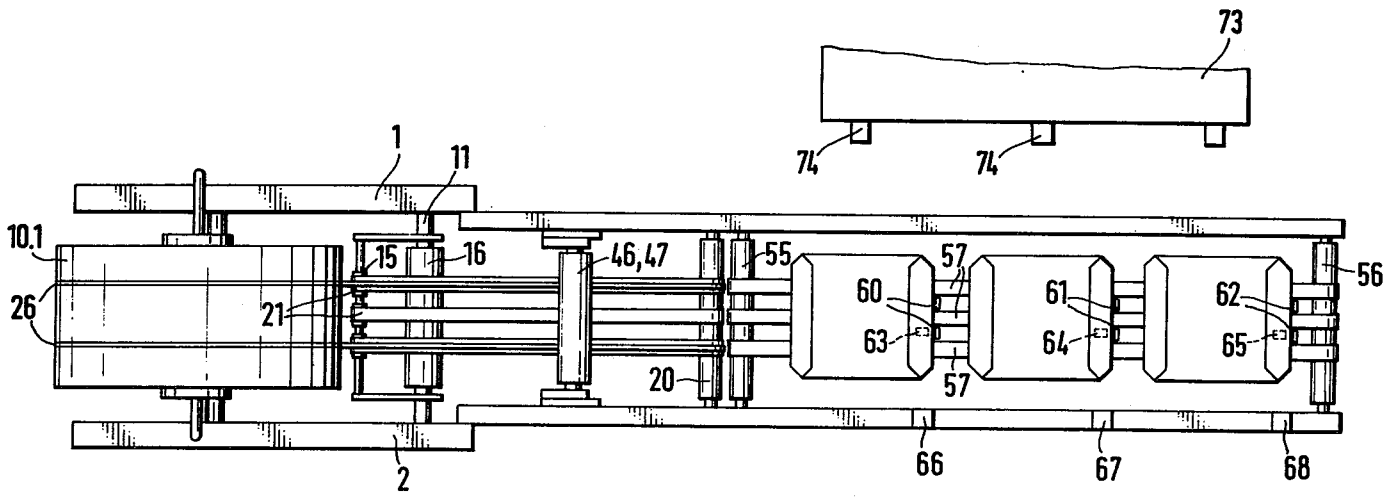
FIG. 3 is a further diagrammatic plan view of the apparatus.
Figure 4:
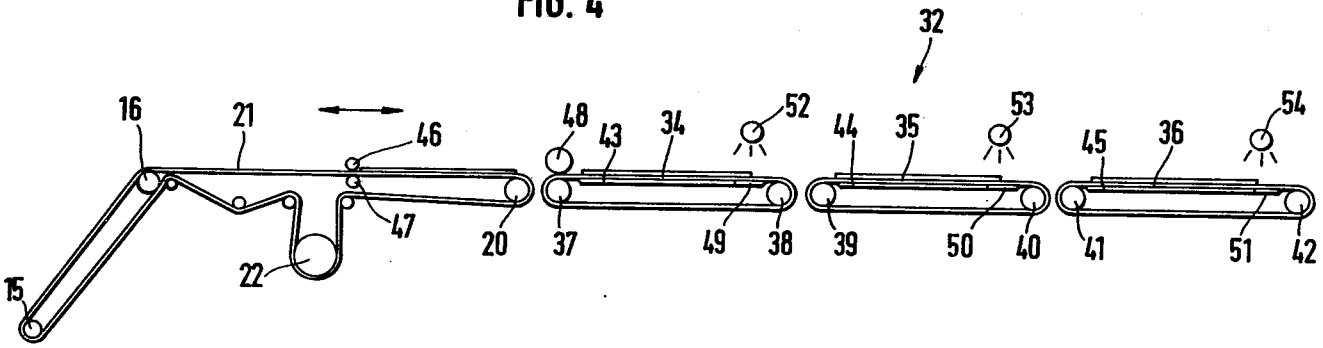
FIG. 4 is a diagrammatic side elevation of the driving and conveying components.
Figure 5:
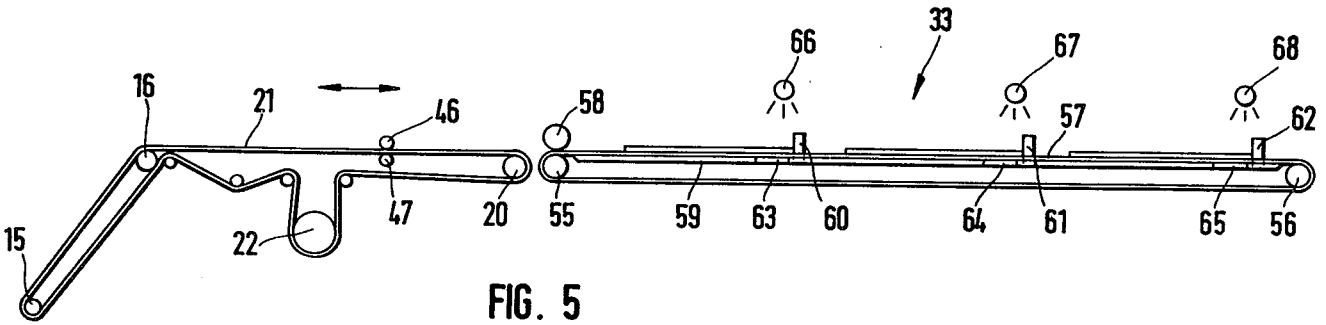
FIG. 5 is a diagrammatic side elevation showing a modification of the second conveyor means.

In line with the conveyor belts 21 leading to the guide roller 20 there are further belt guides 32 or 33 as illustrated in FIGS. 3, 4 and 5. They move more rapidly than the conveyor belts 21 so that the sacks arriving on the conveyor belts 21 in overlapping formation are separated on the belt guides 32 or 33. In the examples of FIGS. 3, 4 and 5, the sacks are to be separated so that three adjoining sacks can on each occasion be engaged by the grippers of the automatic sack-placing machinery.

The belt guide 32 illustrated in FIG. 4 consists of three conveyor belts 34, 35 and 36 which closely adjoin one another and the conveyor belts 21. They pass over guide rollers 37, 38 or 39, 40 or 41, 42, one of each of these pairs of guide rollers being driven by a motor (not shown). Tables 43 to 45 on which the upper runs of the conveyor belts 34 to 36 slide are provided between the guide rollers 37, 38 or 39, 40 or 41, 42. A pair of rollers 46, 47 is provided at the runs of the conveyor belts 21 coming from the supply reel 10, the upper roller 46 being resiliently pivotable as well as rotatable about its axis and lying on the overlapping formation of sacks. The lower roller 47 is mounted in the stand 3 for rotation about its axis. The upper runs of the conveyor belts 21 lie on it. The pair of rollers 46, 47 is adjustable in the conveying direction of the belts 21. It is set so that it lies against the second from last sack. The last sack is therefore freely accessible and can be engaged by the grippers of an automatic sack placing machine for placing on the filling nipple of a sack-filling apparatus, even if the belt guides 32 or 33 are omitted. This example shows how three automatic sack placing machines can be supplied simultaneously.

Above the guide roller 37 there is a feed roller 48 which resiliently lies on the conveyor belts 34 passing over the guide roller 37 or on the sacks being conveyed. This ensures that the last sack of the overlapping formation is withdrawn. By reason of the higher speed of the conveyor belts 34 to 36, the sacks withdrawn from the supply reel 10 in the form of an overlapping formation are separated in accordance with the speed difference between the conveyor belts 21 and 34. The conveyor belts 34 to 36 run at equal speeds so that the spacing between the sacks withdrawn from the overlapping formation remains constant. Let into the tables 43 to 45 upstream of the guide rollers 38, 40, 42 there are mirrors 49, 50, 51 which co-operate with reflection photocells 52, 53, 54. As soon as an arriving sack interrupts the beam between the mirror 51 and the reflection photocell 54, the conveyor belts 36 are stopped. A sequence switch of a connected switching mechanism (not shown) thereby activates the reflection photocell 53 which stops the conveyor belts 35 as soon as the arriving sack has interrupted the beam of the reflection photocell 53, and finally the conveyor belts 34 are stopped when the last sack has reached its position. At this instant the aforementioned switching mechanism gives an impulse to the automatic sack placing machine (not shown) which is set up adjacent the apparatus and which, by means of its grippers, engages the sacks lying prepared on the conveyor belts 34 to 36 and places them for example on the filling nipples 74 of automatic sack-filling machines 73. The individual conveyor belts 34 to 36 of the belt guide 32 could also be replaced in accordance with FIG. 5 by a single belt guide 33 in which conveyor belts 57 run between guide rollers 55 and 56, the conveyor belts being driven independently of the conveyor belts 21 and moving more rapidly than same. Again, above the first roller, namely the guide roller 55, there is a feed roller 58 which has the same functions as the feed roller 48. The upper runs of the conveyor belts 57 pass along a table 59. As will be evident from FIGS. 3 and 5, abutments 60, 61 and 62 are arranged between the conveyor belts 57, the abutments 60, 61 being movable downwardly and the abutments 62 being fixed to the stand 3 of the machine. Mirrors 63 to 65 in the table 59 co-operate with reflection photocells 66 to 68 in the same way as the mirrors 49 to 51 co-operate with the reflection photocells 52 to 54. By interrupting the light beam between the mirror 65 and the reflection photocell 68 by means of an arriving sack, the reflection photocell 67 is activated and the abutments 61 are lifted. After interruption of the light path 64, 67, the reflection photocell 66 is activated and the abutments 60 are elevated. By interrupting the light path 63, 66, an impulse for stopping the conveyor belts 21 and 57 is given to the automatic sack placing machinery which feeds the prepared sacks in the above-described manner to the automatic sack-filling machine.

After removal of the sacks from the belt guides 32, 33 or from the conveyor belts 21, the switching mechanism gives an impulse to the gear motor 23, which starts to turn so that further sacks of the overlapping formation are unreeled from the supply reel 10 and fed to the or each automatic sack placing machine.

I claim:

1. Apparatus for separating valved sacks stored in overlapping formation on reels and supplying same to means for conveying them to filling machines, the improvement comprising: a stand provided with bearings for receiving the reel, the stand comprising a frame carrying rollers at opposite ends, that a driven endless belt passes over the rollers and the frame can be applied to the reel or the reel to the frame so that the endless belt presses on the reel periphery for driving same, and that the stand is provided with spools for coiling the holding bands that are pulled off together with the overlapping sacks during unreeling thereof and with a supply belt downstream of the endless reel-driving belt for transporting the overlapping valved sacks, the supply belt being followed by conveyor means which separate the overlapping valved sacks and successively lead same at a faster speed to the means for conveying them to the filling machine.

2. Apparatus according to claim 1, characterised in that the frame is in the form of a rocker and can be pressed against the reel periphery by a piston-cylinder pressure unit.

3. Apparatus according to claim 1, characterised in that the reel-driving belt is passed over further rollers to form the supply belt for transporting the unreeled overlapping valved sacks.

4. Apparatus according to one of claims 1, characterised in that for separating the valved sacks from the overlapping formation there is provided a faster conveyor belt above the upstream end of which there is a cylinder or rollers for pressing the arriving sacks against said belt.

5. Apparatus according to claim 1, characterised in that a rotary brake is provided on the shaft of the supply reel.

6. Apparatus according to claim 5, characterised in that the rotary brake is a friction brake.

7. Apparatus according to claim 5, characterised in that the braking torque of the rotary brake is adjustable.

8. Apparatus according to claim 1, characterised in that the spools for coiling the withdrawn holding bands can be driven by rotary field magnets.

9. Apparatus according to claim 1, characterised in that the conveyor means for leading on the valved sacks consist of a plurality of individually drivable conveyor belts.

10. Apparatus according to claim 1, characterised in that the conveyor means is provided with reflection photocells.

11. Apparatus according to claim 10, characterised in that the conveyor means is provided with abutments.

12. Apparatus according to claim 11, characterised in that the abutments can be raised and lowered.

13. Apparatus according to claim 2, characterised in that the reel-driving belt is passed over further rollers to form the supply belt for transporting the unreeled overlapping valved sacks.

14. In an apparatus for unreeling and separating valved sacks stored in overlapping formation on a reel by means of a holding band and supplying same to means for conveying them to a filling machine, the improvement comprising: stand means provided with bearings for receiving a reel, the stand means comprising a frame carrying rollers at opposite ends; a driven endless belt passing over the rollers and the frame; movement means for relatively moving the frame and the reel so that the driven endless belt means presses on the reel periphery for driving same; a spool for coiling the holding band that is pulled off from the real together with the overlapping sacks during unreeling thereof; and belt means positioned downstream of the driven endless belt for transporting the unreeled overlapping valved sacks to separate the overlapping valved sacks and successively lead same at a faster speed to the means for conveying them to the filling machine.

15. Apparatus according to claim 14, characterised in that the frame is pivotally mounted to the stand and the movement means includes a piston-cylinder pressure unit for moving the frame towards the reel.

16. Apparatus according to claim 14, characterised in that the belt means includes a faster conveyor belt and a cylinder or rollers is positioned above the upstream end of the faster conveyor belt for pressing the arriving sacks against said faster conveyor belt.

17. Apparatus according to claim 14, characterised in that the reel of valved sacks is formed on a shaft and a rotary brake is provided on the shaft.

18. Apparatus according to claim 17, characterised in that the rotary brake is a friction brake.

19. Apparatus according to claim 17, characterised in that the braking torque of the rotary brake is adjustable.

20. Apparatus according to claim 14, characterised in that the stand means includes rotary field magnet means for driving the spool for coiling the holding band.

21. Apparatus according to claim 14, characterised in that the belt means includes a plurality of individually drivable conveyor belts.

22. Apparatus according to claim 14, characterised in that reflection photocell means is associated with the belt means for determining the presence of valved sacks.

23. Apparatus according to claim 22, characterised in that abutment means is associated with the belt means for blocking movement of the valved sacks.

24. Apparatus according to claim 23, characterised in that the abutment means can be raised and lowered.

25. Apparatus according to claim 14, characterised in that the belt means includes a supply belt positioned downstream of the driven endless belt and a faster conveyor belt positioned downstream of the supply belt.

26. Apparatus according to claim 15, characterised in that the belt means includes a supply belt positioned downstream of the driven endless belt and a faster conveyor belt positioned downstream of the supply belt.

* * * * *